US008749242B2

(12) United States Patent
Clark

(10) Patent No.: US 8,749,242 B2
(45) Date of Patent: Jun. 10, 2014

(54) SYSTEM AND METHOD FOR EMPLOYING ALTERNATING REGIONS OF MAGNETIC AND NON-MAGNETIC CASING IN MAGNETIC RANGING APPLICATIONS

(75) Inventor: Brian Clark, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 608 days.

(21) Appl. No.: 12/999,552

(22) PCT Filed: Apr. 6, 2009

(86) PCT No.: PCT/US2009/039645

§ 371 (c)(1),
(2), (4) Date: Feb. 21, 2011

(87) PCT Pub. No.: WO2010/008634

PCT Pub. Date: Jan. 21, 2010

(65) Prior Publication Data

US 2011/0133741 A1 Jun. 9, 2011

Related U.S. Application Data

(60) Provisional application No. 61/075,489, filed on Jun. 25, 2008.

(51) Int. Cl.
*G01V 3/08* (2006.01)

(52) U.S. Cl.
USPC ..... 324/345; 324/338; 324/346

(58) Field of Classification Search
USPC ..... 324/345, 346, 338, 339, 207.11, 324/207.13, 207.14, 207.15, 207.22, 324/207.23, 207.26; 175/40, 45, 50; 166/66.5
See application file for complete search history.

(56) References Cited

U.S. PATENT DOCUMENTS

| | | | |
|---|---|---|---|
| 3,731,752 | A | 5/1973 | Schad |
| 4,710,708 | A | 12/1987 | Rorden |
| 5,485,089 | A | 1/1996 | Kuckes |
| 5,589,775 | A | 12/1996 | Kuckes |
| 5,923,170 | A | 7/1999 | Kuckes |
| 6,736,222 | B2 | 5/2004 | Kuckes |

OTHER PUBLICATIONS

Kuckes, A.F. et al, New Electromagnetic Surveying/Ranging Method for Drilling Parallel Horizontal Twin Wells, SPE 27466, Dallas, Texas, Feb. 15-18, pp. 85-90.

Grills, Tracy L., Magnetic Ranging Technologies for Drilling Steam Assisted Gravity Drainage Well Pairs and Unique Well Geometries—A Comparison of Technologies, SPE 79005, Calgary, Alberta, Canada, Nov. 4-7, 2002.

*Primary Examiner* — Reena Aurora
(74) *Attorney, Agent, or Firm* — Kimberly Ballew

(57) ABSTRACT

A system and methods for facilitating drilling and/or drilling a well in an orientation with respect to an existing well are provided. Specifically, one method in accordance with present embodiments is directed to producing a magnetic field with a magnetic field source positioned in a non-magnetic region of casing within a first well, wherein the first well is cased with alternating regions of magnetic casing and non-magnetic casing. The method may also include producing at least one output from at least one magnetic field sensor capable of sensing directional magnetic field components, wherein the at least one output is based on detection of the magnetic field and wherein the at least one magnetic field sensor is positioned in a second well.

18 Claims, 6 Drawing Sheets

SYSTEM AND METHOD FOR EMPLOYING ALTERNATING REGIONS OF MAGNETIC AND NON-MAGNETIC CASING IN MAGNETIC RANGING APPLICATIONS

This application claims the benefit of U.S. Provisional Application No. 61/075,489.

FIELD OF THE INVENTION

The present invention relates generally to well drilling operations and, more particularly, to a system and method for magnetic ranging to a cased well.

BACKGROUND OF THE INVENTION

In order to access certain types of hydrocarbons in the earth, it may be necessary or desirable to drill wells or boreholes in a certain spatial relationship with respect to one another. Specifically, it may be desirable to drill a borehole such that it has a specific location relative to a previously drilled borehole. For example, heavy oil may be too viscous in its natural state to be produced from a conventional well, and, thus, an arrangement of cooperative wells and well features may be utilized to produce such oil. Indeed, to produce heavy oil, a variety of techniques may be employed, including, for example, Steam Assisted Gravity Drainage (SAGD), Cross Well Steam Assisted Gravity Drainage (X-SAGD), or Toe to Heel Air Injection (THAI). While SAGD wells generally involve two parallel horizontal wells, X-SAGD and THAI wells generally involve two or more wells located perpendicular to one another.

X-SAGD and THAI techniques function by employing one or more wells for steam injection or air injection, respectively, known as "injector wells." The injector wells pump steam or air into precise locations in a heavy oil formation to heat heavy oil. One or more lower horizontal wells, known as "producer wells," collect the heated heavy oil. For an X-SAGD well pair including an injector well and a producer well, the injector well is a horizontal well located above and oriented perpendicular to the producer well. In contrast, for a THAI well pair including an injector well and a producer well, the injector well is a vertical well located near and oriented perpendicular to the producer well.

Steam or air from an injector well in an X-SAGD or THAI well pair should be injected at a precise point in the heavy oil formation to maximize recovery. Particularly, if steam is injected too near to a point of closest approach between the injector well and the producer well, steam may be shunted out of the formation and into the producer well. Using some conventional techniques, the point of closest approach between the two wells may be difficult to locate or the location of the point of closest approach may be imprecise.

Moreover, the relative distance between the injector and producer wells of an X-SAGD or THAI well pair may affect potential recovery. The wells should be located sufficiently near to one another such that heavy oil heated at the injector well may drain into the producer well. However, if the wells are located too near to one another, steam or air from the injector well may shunt into the producer well, and if the wells are located too far from one another, the heated heavy oil may not extend to the producer well.

Using many conventional techniques, it may be difficult to accurately drill one well in a specified relationship relative to another well. Indeed, standard measurement while drilling (MWD) direction and inclination measurements are usually too inaccurate to maintain proper spacing and relative positioning between two wells over their entire lengths. In part, this is because the location of each well becomes more uncertain as the length of the well increases. For example, the uncertainties may be represented as ellipses at different well lengths that represent the area in which the well may be located at a particular point. These ellipses increase in area with drilled depth. Thus, it is very difficult to accurately position wells relative to one another. Indeed, if the ellipses for a pair of wells overlap, there is potential for a collision between the wells. For these reasons, a standard practice is to use magnetic ranging to position one well with respect to another (e.g., a SAGD pair). However, magnetic ranging can be challenging for certain applications. For example, it may be difficult and/or expensive to use magnetic ranging when two wells are to be placed a relatively large distance from one another.

SUMMARY

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

One method in accordance with exemplary embodiments includes a method for determining a geometric relationship of a second well with respect to a first well. Specifically, the method may include producing a magnetic field with a magnetic field source positioned in a non-magnetic region of casing within the first well, wherein the first well is cased with alternating regions of magnetic casing and non-magnetic casing. Further, the method may include producing at least one output from at least one magnetic field sensor capable of sensing directional magnetic field components, wherein the at least one output is based on detection of the magnetic field and wherein the at least one magnetic field sensor is positioned in the second well.

A method in accordance with exemplary embodiments may include a method of well preparation. The method may include determining a spacing distance between locations for taking periodic magnetic ranging measurements to facilitate determining a geometric relationship between a first well and a second well, and casing the first well with alternating regions of magnetic and non-magnetic casing, wherein two or more regions of the non-magnetic casing are separated with a region of the magnetic casing by the determined spacing distance.

A method in accordance with exemplary embodiments may include a method for determining a geometric relationship of a second well with respect to a first well. The method may include producing a magnetic field with a magnetic field source component of a drilling tool positioned within the second well, and producing at least one output from at least one magnetic field sensor capable of sensing directional magnetic field components in response to detection of the magnetic field, wherein the at least one magnetic field sensor is positioned in a non-magnetic region of casing within the first well and wherein the first well is cased with alternating regions of magnetic casing and non-magnetic casing.

A system in accordance with exemplary embodiments may include casing for facilitating magnetic ranging while drilling. Specifically, the system may include alternating regions of magnetic casing and non-magnetic casing disposed in a borehole, wherein the alternating regions comprise a pattern wherein a first region of non-magnetic casing is separated from a second region of non-magnetic casing by a region of magnetic casing having a length L, the length L having a value corresponding to accuracy limitations related to a magnetic ranging technique.

BRIEF DESCRIPTION OF THE DRAWINGS

Advantages of the invention may become apparent upon reading the following detailed description and upon reference to the drawings in which.

DETAILED DESCRIPTION OF SPECIFIC EMBODIMENTS

One or more specific embodiments of the present invention are described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In the following detailed description, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
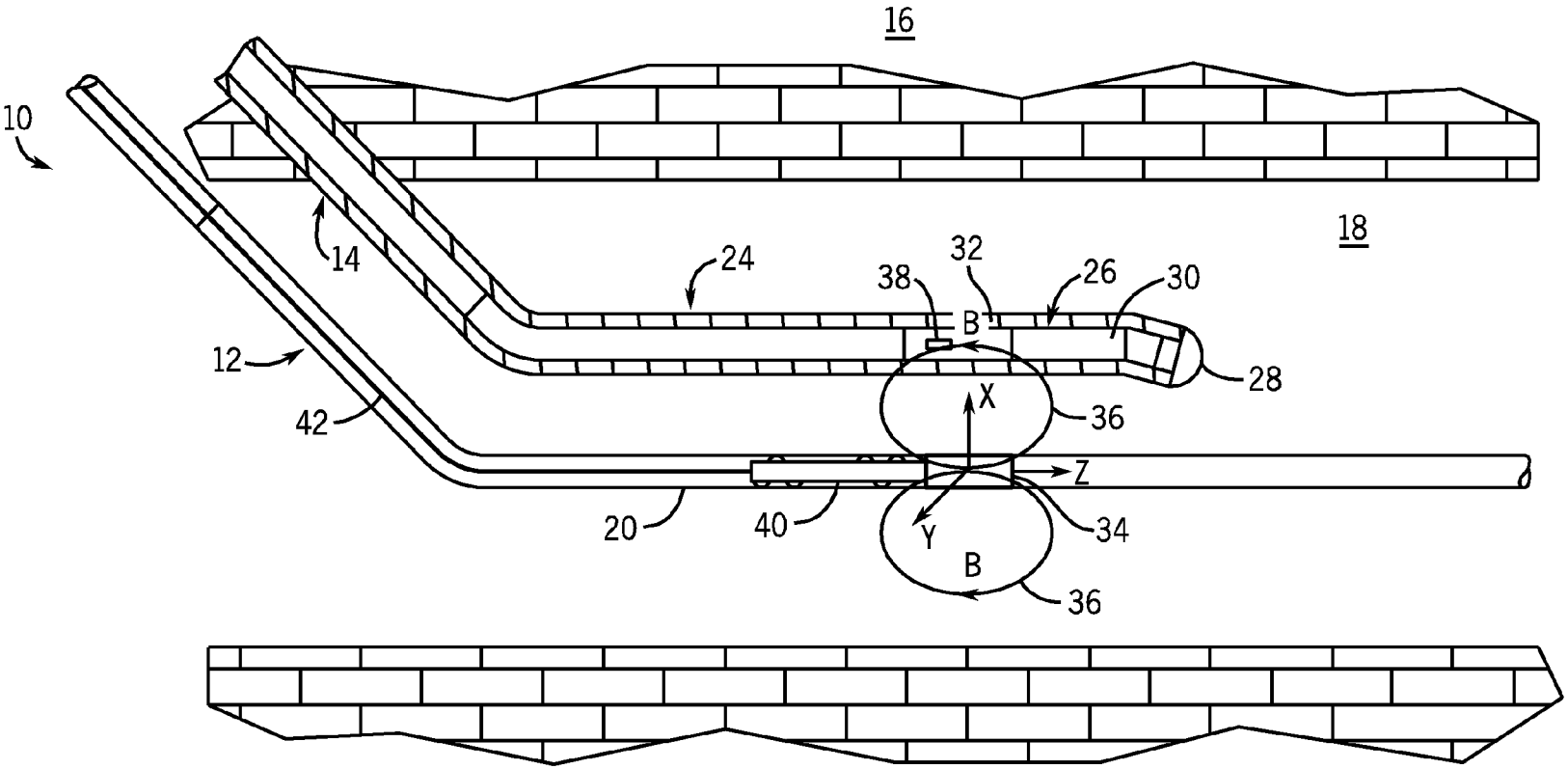
FIG. 1 depicts a traditional well drilling operation involving magnetic ranging while drilling.

FIG. 1 depicts a traditional well drilling operation 10 involving magnetic ranging while drilling. Specifically, the well drilling operation 10 may include the formation of a pair of SAGD wells. Indeed, as illustrated in FIG. 1, an existing first well 12 and a second well 14 in the process of being drilled extend from the surface through a formation 16 into a heavy oil zone 18. The first well 12 is cased with casing 20 (e.g., a slotted or perforated liner) and may eventually function as the producer well of the SAGD pair. As is typical for placement of producer wells, the first well 12 is placed near the bottom of the heavy oil zone 18. Further, as is typical for a SAGD pair, the second well 14 is positioned above the first well 12, and may be used to inject steam into the heavy oil zone 18. For example, the second well 14 may be positioned a vertical distance of 5±1 meters above the essentially horizontal portion of the first well 12, and within ±1 meters of the vertical plane defined by the axis of the first well 12. The length of the horizontal portion typically varies from approximately 500 to 1500 meters for SAGD wells. In the illustrated embodiment, a drill string 24 is being used to drill the second well 14. The drill string 24 includes a bottom hole assembly (BHA) 26 having a drill bit 28, a steerable system 30, and a measurement while drilling (MWD) tool 32.

Maintaining the relative positioning between the first well 12 and the second well 14 with any precision is generally beyond the capability of conventional procedures that utilize MWD direction and inclination measurement. Accordingly, standard magnetic ranging is typically used to determine the distances between and relative positioning of the wells (e.g., the first well 12 and the second well 14). For example, a solenoid 34 may be placed in the first well 12 and energized with current to produce a magnetic field 36 for use in magnetic ranging measurements. The solenoid 34 may include a long magnetic core wrapped with numerous turns of wire.

The magnetic field 36 produced by the solenoid 34 may have a known strength and produce a known field pattern that can be measured in the second well 14. Accordingly, a magnetometer 38 (e.g., a 3-axis magnetometer) mounted in the MWD tool 32 and positioned within the second well 14 may be utilized to make observations of the magnetic field 36. Such observations may facilitate a determination of relative positioning of the first well 12 and the second well 14. It should be noted that the solenoid 34 typically must remain generally opposite and within a certain distance of the MWD tool 32 to properly perform magnetic ranging, which may require movement of the solenoid 34 as drilling progresses. For example, the solenoid 34 may be positioned in at least two locations with respect to the MWD tool 32 to acquire a proper measurement. Accordingly, in the illustrated embodiment, a wireline tractor 40 coupled with a cable 42 is utilized to push the solenoid 34 through the first well 12 into different positions relative to the 3-axis magnetometer 38. However, in other embodiments, the solenoid 34 may be pumped down inside tubing, the solenoid 34 may be pushed with coiled tubing, or other techniques may be utilized.

It has now been recognized that, in existing methods of magnetic ranging, either the solenoid or the magnetometer is typically located inside a cased well, and because steel casing typically has a large relative magnetic permeability, $\mu'$, all magnetic fields are strongly affected. First, if a solenoid is located inside steel casing, then the casing will attenuate the magnetic field strength outside the casing. Second, if the magnetometer is placed inside the steel casing, then only the component of the magnetic field parallel to the casing axis will be relatively unaffected, and the traverse components will be highly attenuated. In all of these situations and related situations, the magnetic casing interferes with the accurate placement of the second well relative to the first well.

Exemplary embodiments in accordance with the present invention are directed to methods and systems for facilitating the determination of a geometric relationship between two wells using magnetic ranging techniques. Specifically, an exemplary embodiment is directed to using a periodic structure of non-magnetic casing and magnetic casing for a cased well to enhance magnetic ranging operations used to position wells relative to one another (e.g., SAGD wells). For example, in one embodiment, alternating joints of non-magnetic and magnetic casing may be utilized when completing a well (e.g., a target well in a magnetic ranging application) that will be located in a particular relationship relative to a another well. Exemplary embodiments may be utilized in applications relating to SAGD wells and any other system of wells that are to be arranged in close proximity to each other with controlled spacing. Exemplary embodiments may be particularly useful when a distance between the two wells is relatively large compared to typical applications. Further, exemplary embodiments may reduce costs that would be required for a well cased entirely with non-magnetic casing.

It should be noted that in one embodiment, as set forth in U.S. Provisional Application No. 61/061,542, "Dual Magnetic Sensor Ranging Method and Apparatus," which is incorporated in its entirety by reference herein, multiple magnetometers may be utilized in conjunction to measure a magnetic field form a single magnetic field source. This may conserve rig time and avoid potential errors. Specifically, for example, two or more magnetometers positioned a certain distance apart in a well adjacent the well containing the solenoid 34 may be used to avoid issues with movement of the solenoid 34 and/or a single magnetometer. Details regarding such a system and method are set forth in U.S. Provisional Application No. 61/061,542. However, any number of magnetic ranging techniques may be utilized along with exemplary embodiments of the present invention.

Figure 2:
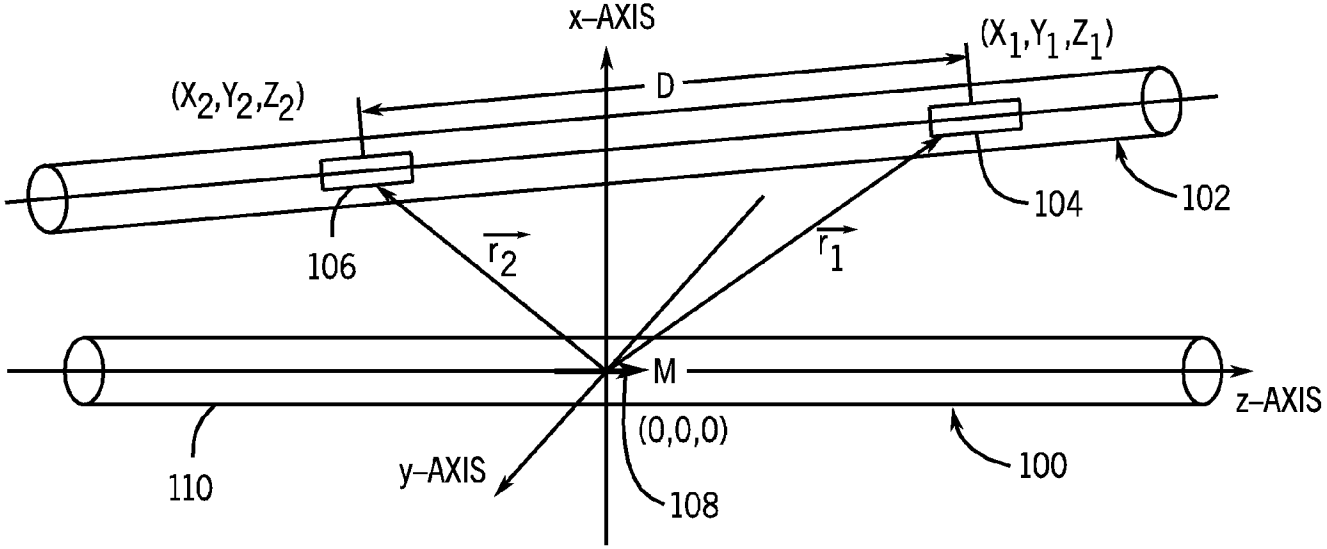
FIG. 2 illustrates a well drilling operation utilizing tools for magnetic ranging while drilling in accordance with exemplary embodiments.

For the purposes of this discussion, a method and system for magnetic ranging using a solenoid located in a cased well (e.g., a producer well of a SAGD pair) and two magnetometers located in a well being drilled (e.g., an injector well of a SAGD pair), such as described in U.S. Provisional Application No. 61/061,542, will be utilized as an example for illustration. Accordingly, FIG. 2 illustrates a first well 100 and a second well 102, wherein a first magnetometer 104 and a second magnetometer 106 are positioned a distance D away from one another within the second well 102, and a magnetic field source or solenoid 108 is located in the first well 100 in accordance with an exemplary embodiment. Each of the magnetometers 104, 106 may be in a fixed position along a downhole tool (e.g., a BHA) that is being used to drill the second well 102, and the solenoid 108 may be disposed within a downhole tool located in the first well 100, which may be cased with casing 110 (e.g., slotted liner).

Figure 3:
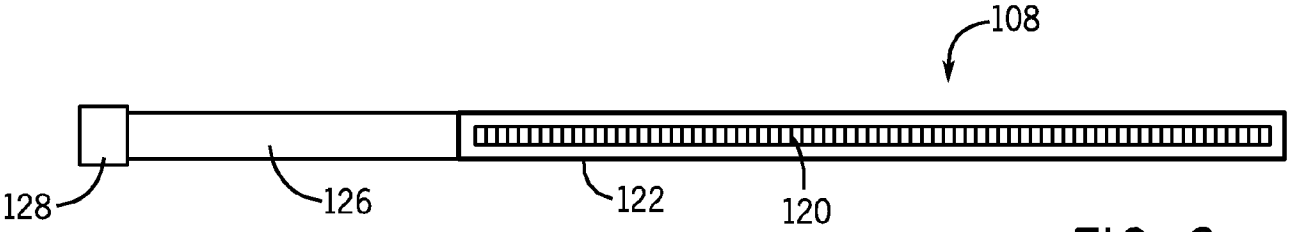
FIG. 3 includes a cross-sectional view of a solenoid in accordance with exemplary embodiments.

Referring to FIG. 3, the solenoid 108 may be constructed with a magnetic core 120 (e.g., mu-metal) and several thousand turns of solid magnetic wire (e.g., #28 gauge magnetic wire). Typical dimensions for the core may be an outer diameter of approximately 7 cm, and a core length between 2 m and 4 m. Solenoid 108 may be encased in a pressure housing 122 made of fiberglass epoxy or other non-magnetic material. Power supply module 126 provides an alternating electric current to drive the solenoid. Connection of the solenoid 108 to other downhole equipment and wireline cable may be achieved via bulkhead 128. The solenoid's magnetic dipole moment may be given by $M=NIA_{EF}$, where N is the number of wire turns, I is the current, and $A_{EF}$ is the effective area which includes the amplification provided by the magnetic core. Experiments have demonstrated that such a solenoid can produce a magnetic moment in air of several thousand amp-meter$^2$ at modest power levels (tens of watts). In a specific example, it may be assumed that the solenoid 108 has the magnetic moment of 1000 amp-meter$^2$ in air. However, if the casing 110 in the first well 100 is made of magnetic steel, the magnetic dipole moment will be attenuated. For example, experiments show that a 7-inch OD steel casing with 0.41-inch wall thickness will attenuate the magnetic field outside the casing by approximately 17 dB at 10 Hz, resulting in an effective magnetic moment of 140 amp-meter$^2$ inside casing, compared to 1000 amp-meter$^2$ in air.

Referring to FIG. 2, let the solenoid 108 be located at (x,y,z)=(0,0,0). For simplicity, the solenoid 108 may be represented mathematically as a point magnetic dipole that is aligned with the borehole direction. That is, the solenoid 108 may be considered to have a magnetic dipole moment $\vec{M}=M\hat{z}$, where $\hat{z}$ is the unit vector pointing along the axis of the first well 100. When the casing 110 is made of steel, the presence of the casing 110 will slightly perturb the shape of the magnetic field, but this can be taken into account with a slight refinement of the model. The primary effect of the casing 110 is to attenuate the strength of the magnetic field.

The first magnetometer 104 in the second well 102 is located at $\vec{r}_1=(x_1,y_1,z_1)$ and the second magnetometer 106 is located at $\vec{r}_2=(x_2,y_2,z_2)$, where the known separation between these two magnetometers 104, 106 is $D=\sqrt{(x_1-x_2)^2+(y_1-y_2)^2+(z_1-z_2)^2}$. The locations of these two magnetometers 104, 106 relative to the solenoid 108 located at (0,0,0) are unknown quantities that can be determined from the magnetometers' measurements as described in the previously mentioned U.S. Provisional Patent Application No. 61/061,542. Once these two points are determined, they define the axis of the second well 102 with respect to the first well 100.

The magnetic fields at $\vec{r}_1$ and $\vec{r}_2$ will have field components along the three directions, x, y, and $\hat{z}$, namely $\vec{B}(\vec{r}_1)=B_x(\vec{r}_1)x+B_y(\vec{r}_1)y+B_z(\vec{r}_1)\hat{z}$, and $\vec{B}(\vec{r}_2)=B_x(\vec{r}_2)x+B_y(\vec{r}_2)y+B_z(\vec{r}_2)\hat{z}$, where $$B_x(\vec{r}_j)=\frac{3\mu_0 M}{4\pi}\left(\frac{x_j z_j}{r_j^5}\right),\quad B_y(\vec{r}_j)=\frac{3\mu_0 M}{4\pi}\left(\frac{y_j z_j}{r_j^5}\right),$$

$$B_z(\vec{r}_j)=\frac{3\mu_0 M}{4\pi}\left(\frac{z_j^2-r_j^2/3}{r_j^5}\right),\text{ and } r_j=|\vec{r}_j|=\sqrt{x_j^2+y_j^2+z_j^2}$$

for j=1, 2. To calculate the signal-noise ratio for a realistic system, 0.1 nTesla precision may be assumed for each magnetometer axis for an AC magnetic field at 10 Hertz.

As a first example, take into consideration a situation where the second well 102 is to be drilled with an inter-well separation of 5 m±1 m relative to the first well 100. In particular, let $\vec{r}_1=(5,0,5)$, $\vec{r}_2=(5,0,-5)$, and D=10, where the distances are in meters unless otherwise noted. With a 7-inch steel casing, the effective magnetic moment is reduced to M=140 amp-meter$^2$ for the previously described solenoid 108 in steel casing. The magnetic field strengths at the magnetometers 104, 106 can be calculated with the above formulas (sans noise). For $\vec{r}_1=(5,0,5)$ and $\vec{r}_2=(5,0,-5)$, $B_y(\vec{r}_1)=B_y(\vec{r}_2)=0$, $|B_x(\vec{r}_1)|=|B_x(\vec{r}_2)|=59.4$ nTesla, and $|B_z(\vec{r}_1)|=|B_z(\vec{r}_2)|=19.8$ nTesla. Adding random noise with a standard deviation of 0.1 nTesla provides a realistic estimate of the signal to noise ratio. The signal to noise ratios are +55 dB for $|B_x(\vec{r}_j)|$ and +46 dB for $|B_z(\vec{r}_j)|$ allowing for a robust determination of the inter-well spacing and relative position using the method described in U.S. Provisional Application No. 61/061,542. The uncertainties due to the random noise are minuscule. The uncertainties in x (vertical separation) and y (transverse distance) are less than 2 centimeters. Of course, other effects (e.g. calibration error) may increase the uncertainties.

As a second example, now consider a different situation where the second well 102 is to be drilled with an inter-well separation of 30 m±1.5 m relative to the first well 100, rather than the more typical 5 m±1 m of the first example. In particular, let $\vec{r}_1=(30,0,15)$, $\vec{r}_2=(30,0,-15)$ and D=30. Again assuming an effective magnetic moment of M=140 amp-meter$^2$ with the casing 110 being made of steel, the magnetic field strengths at the two magnetometers 104, 106 are much weaker: $|B_x(\vec{r}_1)|=|B_x(\vec{r}_2)|=0.45$ nTesla and $|B_z(\vec{r}_1)|=|B_z(\vec{r}_2)|=0.15$ nTesla. Adding 0.1 nTesla noise to simulate realistic situations, the signal to noise ratios are far lower at +13.1 dB for $|B_x(\vec{r}_j)|$ and +3.5 dB for $|B_z(\vec{r}_j)|$. The uncertainties in x and y are now 6.1 meters and 11.4 meters. Hence, this method does not give suitable accuracy when the casing 110 is present and made of steel because it reduces the effective magnetic moment from 1000 amp-meter$^2$ in air to 140 amp-meter$^2$.

Experiments have shown that non-magnetic casing has a much smaller effect on the effective magnetic moment than magnetic steel casing, even at frequencies of 10 Hz and lower. For example, a non-magnetic casing can be made of chromium, which is currently used for oil field applications where corrosion is a problem. Such casing is commercially available from Sumitomo Metal Industries, LTD, which has headquarters at 8-11, Harumi 1-chome, Chuo-ku, Tokyo 104-6111, Japan. For example, SM-2535 is a type of non-magnetic casing available from Sumitomo Metal Industries, LTD. A sample of 7-inch OD chromium casing with a 0.36-inch wall thickness was tested at 10 Hz with the same solenoid used for the magnetic steel casing tests. The effective magnetic dipole moment was reduced from 1000 amp-meter$^2$ in air to 640 amp-meter$^2$ in the chromium casing, an attenuation of only 3.9 dB.

Now reconsider the situation set forth in the second example, where the wells have a separation of 30 m, but with the casing 110 of the first well 100 being chromium casing. Again let $\vec{r}_1=(30,0,15)$, $\vec{r}_2=(30,0,-15)$, and D=30, but the effective magnetic moment is now only reduced to M=640 amp-meter$^2$. The resulting magnetic field sans noise is $|B_x(\vec{r}_1)|=|B_x(\vec{r}_2)|=2.04$ nTesla, and $|B_z(\vec{r}_1)|=|B_z(\vec{r}_2)|=0.68$ nTesla. Adding 0.1 nTesla noise to simulate realistic conditions, the signal to noise ratios are +26.2 dB for $|B_x(\vec{r}_j)|$ and +16.7 dB for $|B_z(\vec{r}_j)|$. This produces uncertainties in x and y of 1.1 meters and 1.5 meters respectively. Hence, the method now gives suitable accuracy with non-magnetic casing.

Accordingly, it has now been recognized that completing the first well 100 with the casing 110, wherein the casing 110 is non-magnetic, allows for a greater separation of the two wells 100, 102. However, it has also now been recognized that the increased cost for non-magnetic casing compared to magnetic steel casing may be a deterrent. Thus, in accordance with exemplary embodiments, the benefits of non-magnetic casing for magnetic ranging can be obtained in a cost-effective manner by interspersing magnetic casing and non-magnetic casing in a well (e.g., the first well 100). For example, regions of non-magnetic casing may be separated by regions of magnetic casing in a well being utilized for magnetic ranging, thus, limiting the use of non-magnetic casing. Additionally, to further conserve expenses, the regions of non-magnetic casing may be substantially smaller than the regions of magnetic casing. Indeed, a region of non-magnetic casing may include a single standard joint or even a modified shorter joint.

Figure 4:
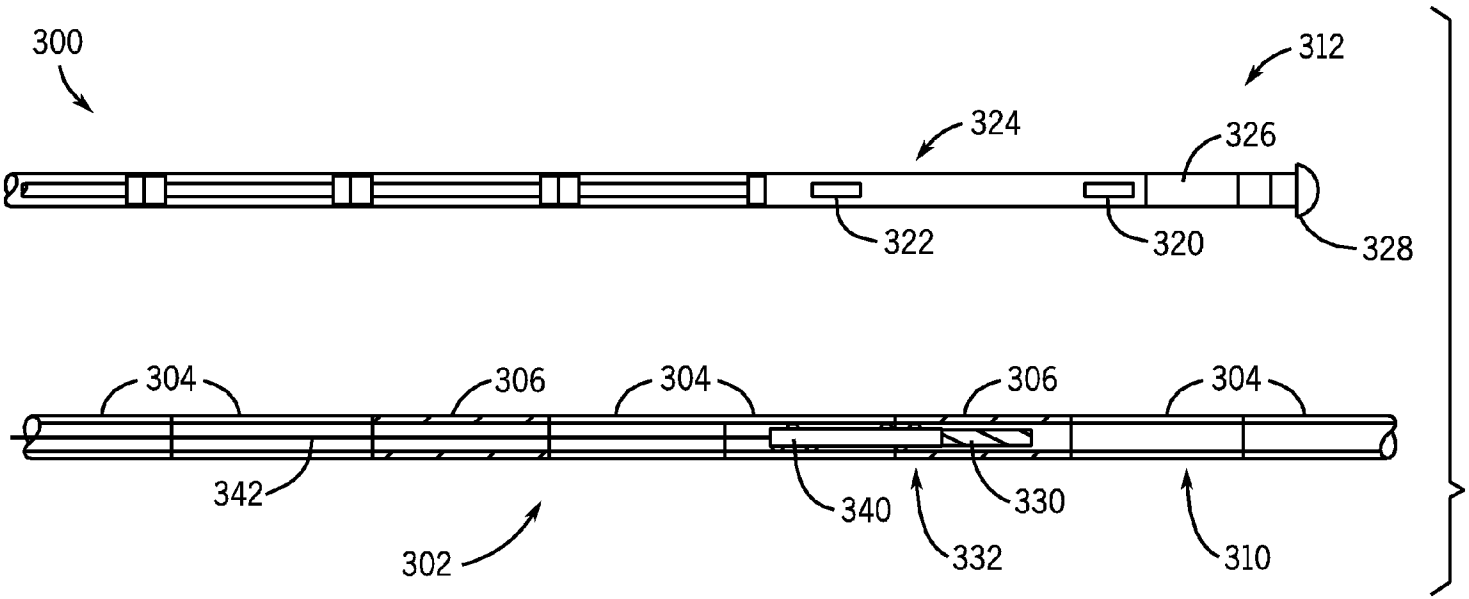
FIG. 4 illustrates a well drilling operation utilizing casing with alternating magnetic casing regions and non-magnetic casing regions to facilitate operation of tools for magnetic ranging while drilling in accordance with exemplary embodiments.

FIG. 4 illustrates a well drilling operation 300 utilizing casing 302 with alternating magnetic casing regions 304 and non-magnetic casing regions 306 to facilitate operation of tools for magnetic ranging while drilling in accordance with exemplary embodiments. Specifically, FIG. 4 illustrates a first well 310 and a second well 312 disposed in a specified orientation relative to one another. The first well 310 has already been drilled and has been cased with the casing 302, which includes the magnetic casing regions 304 (e.g. magnetic steel casing) and non-magnetic casing regions 306 (e.g., non-magnetic steel casing) arranged in an alternating fashion in accordance with exemplary embodiments. For example, the casing 302 of the first well 310 may consist of a repeating sequence of magnetic casing regions 304 and non-magnetic casing regions 306, wherein each of the magnetic casing regions 304 includes two 10 meter joints of magnetic steel casing, and each of the non-magnetic regions 306 includes one 10 meter joint of non-magnetic casing. In other embodiments different region lengths and/or joint lengths may be used in an alternating pattern. Such a periodic use of the magnetic regions 304 may reduce the incremental cost of deploying the non-magnetic casing regions 306 by two-thirds relative to traditional procedures.

In the illustrated embodiment, two magnetometers 320, 322 are disposed in a BHA 324 being used to form the second well 312, and a single solenoid 330 is disposed in a downhole tool 332 within the first well 310. The BHA 324 may include a steerable motor 326, a bit 328, and so forth. Further, in the illustrated embodiment, the magnetic ranging operation may be performed approximately every 30 meters such that the solenoid 330 may be positioned inside one of the non-magnetic regions 306 of casing for each magnetic ranging measurement. After the measurement is performed, a tractor 340 coupled to a wireline cable 342 may drive the solenoid 330 to the next non-magnetic casing region 306, and the BHA 324 may drill ahead. In other embodiments, different lengths of the magnetic casing regions 304 and non-magnetic casing regions 306 may be used depending on relative positioning and so forth, and, thus, measurements may be taken a different intervals (e.g., every 60 meters). It should also be noted that different magnetic ranging techniques may be utilized in accordance exemplary embodiments. For example, ranging techniques using a single magnetometer, an array of magnetometers, or multiple solenoids may be utilized in accordance with exemplary embodiments. Further, in some exemplary embodiments, the solenoid 330 may be located in the well being drilled.

A distance between the non-magnetic casing regions 306 (or a length of each of the magnetic regions 304) may be determined based on the required accuracy for the relationship between the two wells 310, 312, the accuracy of the MWD direction and inclination measurements, and the ability to drill a straight hole in the correct direction. A typical value for the MWD directional accuracy is about ±1° when there is no magnetic interference from nearby cased wells. If the next MWD survey occurs after 30 m, then the potential positional error is: $30\,\text{m}\cdot\sin(1°)\approx 0.5$ m. If larger errors can be tolerated, then the spacing between the non-magnetic casing regions 306 can be greater. For example, each of the non-magnetic casing regions 306 might be placed approximately every 60 m if an additional error of ±1 m is acceptable.

FIG. 4 illustrates a well drilling operation 300 utilizing casing 302 with alternating magnetic casing regions 304 and non-magnetic casing regions 306 to facilitate operation of tools for magnetic ranging while drilling in accordance with exemplary embodiments. Specifically, FIG. 4 illustrates a first well 310 and a second well 312 disposed in a specified orientation relative to one another. The first well 310 has already been drilled and has been cased with the casing 302, which includes the magnetic casing regions 304 (e.g. magnetic steel casing) and non-magnetic casing regions 306 (e.g., non-magnetic steel casing) arranged in an alternating fashion in accordance with exemplary embodiments. For example, the casing 302 of the first well 310 may consist of a repeating sequence of magnetic casing regions 304 and non-magnetic casing regions 306, wherein each of the magnetic casing regions 304 includes two 10 meter joints of magnetic steel casing, and each of the non-magnetic regions 306 includes one 10 meter joint of non-magnetic casing. In other embodiments different region lengths and/or joint lengths may be used in an alternating pattern. Such a periodic use of the magnetic regions 304 may reduce the incremental cost of deploying the non-magnetic casing regions 306 by two-thirds relative to traditional procedures.

Figure 5:
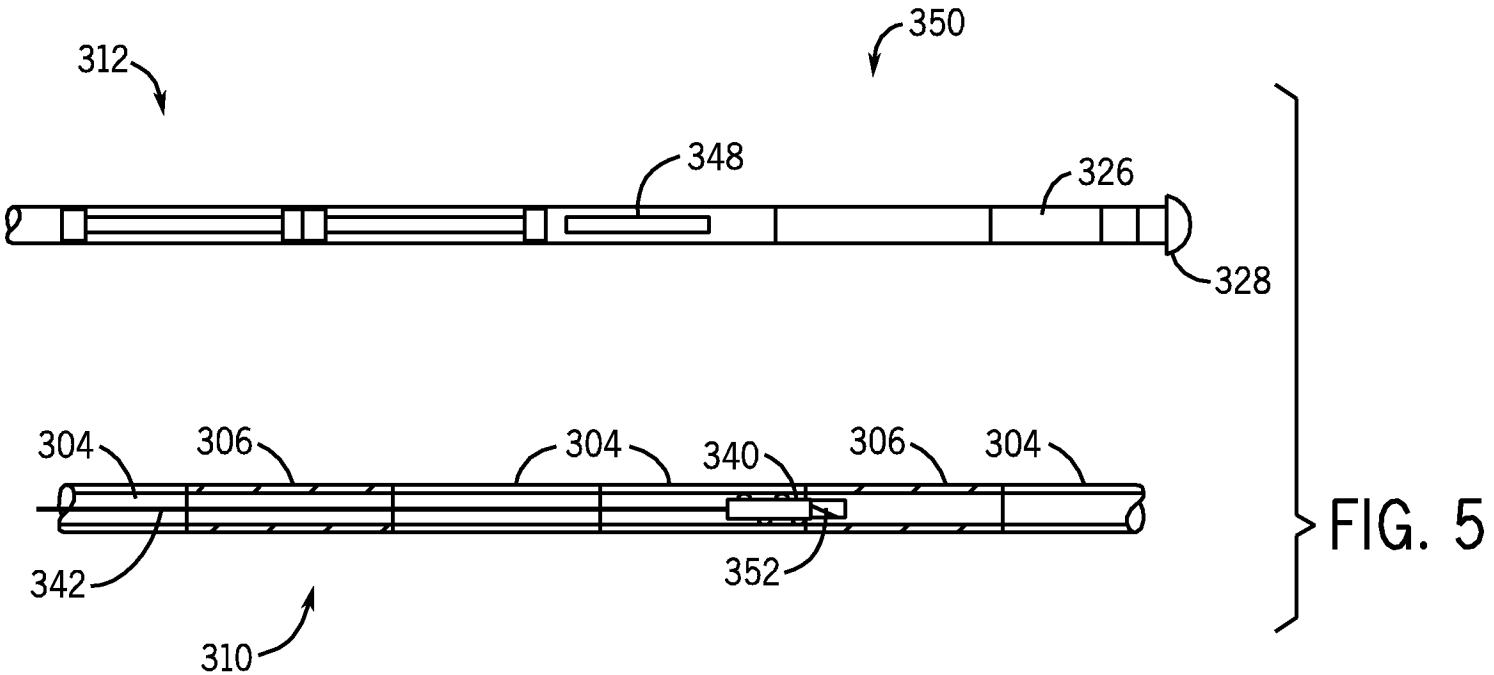
FIG. 5 illustrates a second well drilling operation utilizing casing with alternating magnetic casing regions and non-magnetic casing regions to facilitate operation of tools for magnetic ranging while drilling in accordance with exemplary embodiments.

In a second embodiment illustrated in FIG. 5, a single solenoid 348 is disposed in a BHA 350 being used to form the second well 312, and a magnetometer 352 is disposed within the first well 310. The BHA 350 may include a steerable motor 326, a bit 328, and so forth. Further, in the illustrated embodiment, the magnetic ranging operation may be performed approximately every 30 meters such that the magnetometer 352 may be positioned inside one of the non-magnetic regions 306 of casing for each magnetic ranging measurement. The magnetometer 352 may be moved a distance D by the tractor 340 powered by the wireline cable 342 and a second magnetic field measurement made. For example, if non-magnetic region 306 is 10 m long, the magnetometer 352 may move a distance D=5 m and still remain in non-magnetic region 306. After the measurement sequence is performed, the tractor 340 coupled to the wireline cable 342 may drive the magnetometer 352 to the next non-magnetic casing region 306, and the BHA 350 may drill ahead. In other embodiments, different lengths of the magnetic casing regions 304 and non-magnetic casing regions 306 may be used depending on relative positioning and so forth, and, thus, measurements may be taken at different intervals.

Figure 6:
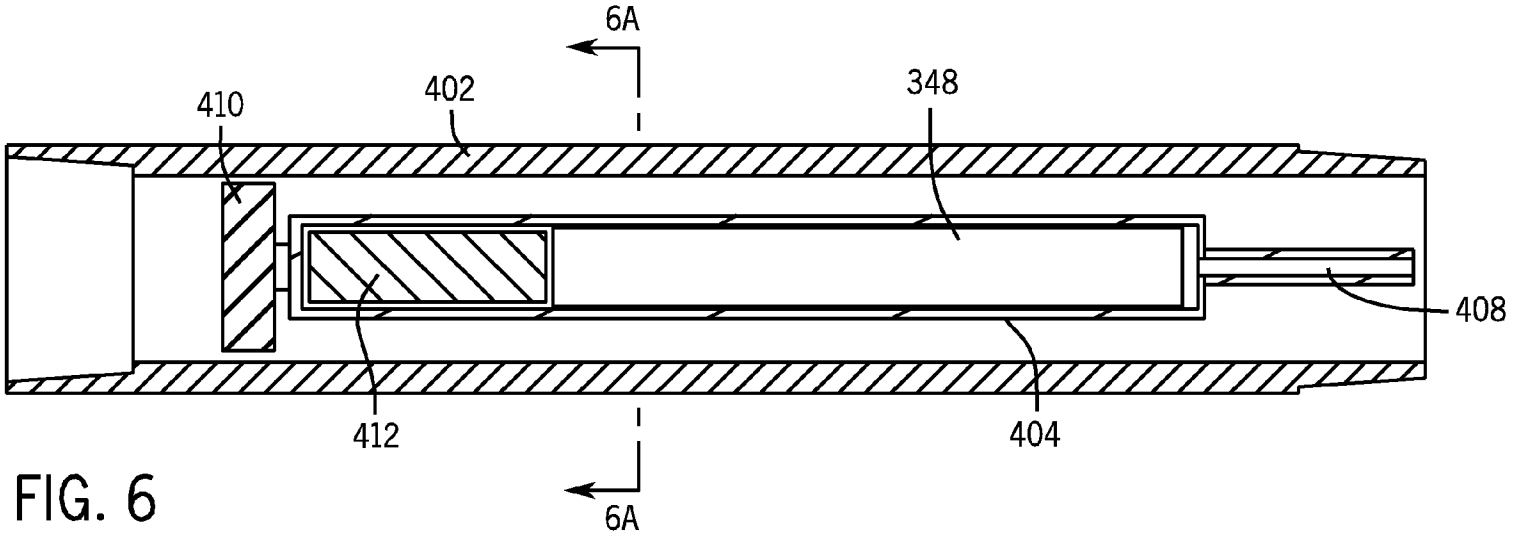
FIG. 6 includes a cross-sectional view of a solenoid in accordance with exemplary embodiments.
Figure 6A:
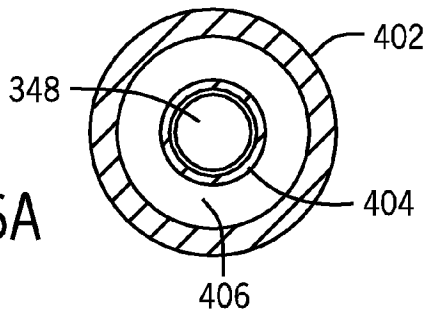

FIG. 6 includes a pair of cross-sectional views of the solenoid 348 in accordance with an exemplary embodiment. The solenoid 348 may be mounted in the bore of a drill collar 402 (e.g., a non-magnetic drill collar) and aligned with the drill collar's axis. A housing 404 made of a non-magnetic material (e.g., fiberglass) may protect the windings of the solenoid 348 from the drilling fluid which flows in the annular region or mud channel 406 between the housing 404 and the drill collar 402. Operated in AC mode, the solenoid's magnetic field may readily penetrate the housing 404 and drill collar 402 at frequencies of 10 Hz and lower. An inter-tool communication bus 408 may connect the solenoid 408 to the other drilling tools in a BHA, such as an MWD tool. A turbine 410 may be used to generate electrical power for power and control electronics 412 of the solenoid 348, or batteries may be used to power the solenoid 348.

Figure 7:
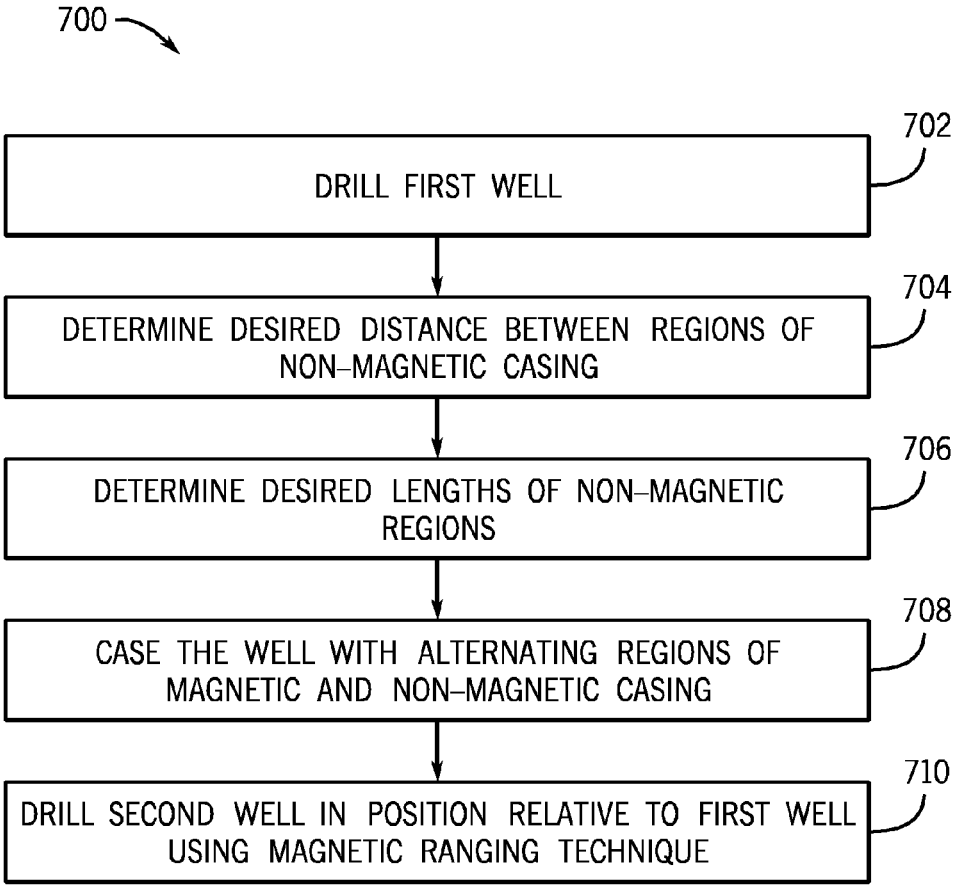
FIG. 7 illustrates a process flow diagram in accordance with exemplary embodiments.

FIG. 7 illustrates a method in accordance with exemplary embodiments. The method is generally indicated by reference numeral 700. The method 700 begins, as represented by block 702, with drilling a first well. This first well may be utilized in a magnetic ranging application. For example, the first well may be used as a target well in a magnetic ranging application. Indeed, a magnetic ranging technique may be utilized to position a second well relative to the first well. The first well may be cased with alternating regions of magnetic and non-magnetic casing. As represented by block 704, a distance between non-magnetic regions (or a length of magnetic regions) may be determined based on a desired accuracy, desired geometric relationships between the first well and a second well, accuracy of related measurements (e.g., MWD measurements), available capabilities relating to drilling accuracy and consistency, and so forth. As represented by block 706, a determination may also be made regarding the lengths for each of the regions of non-magnetic casing. In some embodiments, the lengths may vary in different parts of the well. For example, it may be desirable to utilize more non-magnetic casing in deeper portions of the drilled well than in the shallower portions. Block 708 represents casing the well by inserting the alternating regions of magnetic and non-magnetic casing. Further, block 710 represents drilling the second well relative to the first well using a magnetic ranging technique wherein readings are taken at intervals when a ranging tool is positioned within and/or near the regions of non-magnetic casing. It should be noted that in some exemplary embodiments, the method 700 may not be performed in the illustrated order, and other steps or acts may be performed or omitted.

As indicated above, periodic placement of non-magnetic casing between regions of magnetic casing may be useful in a variety of magnetic ranging applications. For example, in one embodiment, a magnetic field sensor may be placed in a region of non-magnetic casing disposed between regions of magnetic casing. Specifically, a magnetometer (e.g., a flux-gate magnetometer) attached to a wireline may be placed in such a position. The magnetic field sensor may then remain stationary during data acquisition while a BHA including a magnetic field source (e.g., a solenoid, or a rotating magnet) drills past the magnetic field sensor. Since the casing is non-magnetic, the three components of the magnetic field produced by the magnetic field source will readily penetrate into the casing and can be accurately measured by the magnetic field sensor. This process may be utilized with an array of sensors positioned along an entire length or substantially an entire length of a cased well. In another exemplary embodiment, a magnetic field source (e.g., a solenoid) may be moved between locations inside a cased well, and resulting magnetic fields may be measured by a magnetic field sensor of a BHA disposed in another well during one magnetic ranging operation. In such an embodiment, the magnetic field source may move a distance approximately equal to the inter-well spacing. For example, the non-magnetic casing may be placed between magnetic casing at 30 m intervals for a large inter-well spacing (e.g. 30 m). In other embodiments, different spacing may be used between regions of non-magnetic casing.

Exemplary embodiments may also be utilized in magnetic ranging applications where a precise spacing and relationships between two or more wells is required. In this situation, at least one well may contain a periodic structure of non-magnetic and magnetic casing, wherein the non-magnetic casing regions function as windows for observation of a magnetic field. The well with the non-magnetic regions may be drilled first and completed. Then, the other wells may be drilled with respect to the first well using magnetic ranging. It should also be noted that different types of non-magnetic casing may be utilized in accordance with exemplary embodiments. For example, non-magnetic slotted liner, perforated liner, or the like may be utilized in accordance with exemplary embodiments.

Exemplary embodiments facilitate magnetic ranging techniques by facilitating transmission and/or detection of magnetic fields without the expense of using large amount of expensive non-magnetic casing relative to traditional techniques. Specifically, exemplary embodiments utilize a periodic structure of non-magnetic casings and magnetic casings for a cased well (e.g., a target well in a magnetic ranging application) to enhance magnetic ranging operations. The spacing between the non-magnetic casing regions may be determined by the accuracy required in the relative separations of the two wells. This may be particularly useful when the distance between the two wells is large. The distances between non-magnetic regions may be periodic (i.e. equal spacing) or non-periodic (i.e. unequal spacing). Unequal spacing may be advantageous if the placement accuracy requirements vary along the length of the well. Further, present embodiments may reduce the cost that would be required for a well cased entirely with non-magnetic casing, which would otherwise be required to achieve the same accuracy and the large distance between the two wells.

While only certain features of the invention have been illustrated and described herein, many modifications and changes will occur to those skilled in the art. For example, although the invention has been described involving dual magnetometers in a BHA and a solenoid deployed on wireline, the magnetometers could also be deployed in any of various tools, such as an MWD tool, a coiled tubing tool, or in a slick line. It is, therefore, to be understood that the appended claims are intended to cover all such modifications and changes as fall within the true spirit of the invention.

What is claimed is:

1. A method for determining a geometric relationship of a second well with respect to a first well, comprising the steps of:

producing a magnetic field with a magnetic field source positioned in a non-magnetic region of casing within the first well, wherein the first well is cased with alternating regions of magnetic casing and non-magnetic casing wherein each magnetic region has a length, the length of each of the magnetic regions is based on an accuracy value for related drilling measurements, values relating to a desired geometric relationship between the first well and the second well, or a value associated with drilling consistency; and producing at least one output from at least one magnetic field sensor capable of sensing directional magnetic field components, wherein the at least one output is based on detection of the magnetic field, and the at least one magnetic field sensor is positioned in the second well.

2. The method of claim 1, comprising moving the magnetic field source in intervals of an approximate distance corresponding to a distance between the regions of non-magnetic casing to facilitate taking a series of measurements.

3. The method of claim 1, comprising installing the alternating regions of magnetic casing and non-magnetic casing such that a first region of non-magnetic casing is separated from a second region of non-magnetic casing by a region of magnetic casing having a separation length.

4. The method of claim 3, comprising determining a value for the separation length based on an accuracy limitation.

5. The method of claim 3, comprising determining a value of the separation length based on values relating to a desired geometric relationship between the first well and the second well, an accuracy value for related drilling measurements, and/or a value associated with drilling consistency.

6. The method of claim 1, comprising moving the magnetic field source to a second position within the first well that is cased with another region of non-magnetic casing.

7. The method of claim 1, comprising determining the geometric relationship of the second well with respect to the first well as a function of the at least one output.

8. The method of claim 7, comprising determining a distance and direction of the second well with respect to the first well as a function of the at least one output.

9. The method of claim 1, comprising activating the magnetic field source by implementing AC energizing of the magnetic field source.

10. The method of claim 1, wherein the steps are performed in the listed order.

11. The method of claim 1, comprising: producing a first output from a first magnetic field sensor subsystem for sensing directional magnetic field components, the first output responsive to the magnetic field; and producing a second output from a second magnetic field sensor subsystem for sensing directional magnetic field components, the second output responsive to the magnetic field, wherein the first and second magnetic field sensor subsystems are positioned a distance apart from one another within the second well.

12. The method of claim 11, wherein the first and second magnetic field sensor subsystems are spaced apart by a spacing D, and wherein determining the geometric relationship of the second well with respect to the first well comprises determining the geometric relationship as a function of the first output, the second output, and the spacing D.

13. A method of well preparation, comprising: determining a spacing distance between locations for taking periodic magnetic ranging measurements to facilitate determining a geometric relationship between a first well and a second well; and casing the first well with alternating regions of magnetic and non-magnetic casing, wherein two or more regions of the non-magnetic casing are separated with a region of the magnetic casing by the determined spacing distance.

14. The method of claim 13, comprising determining multiple different spacing distances for different well depths.

15. The method of claim 13, wherein determining the spacing distance comprises taking into account an accuracy limitation.

16. The method of claim 13, wherein determining the spacing distance comprises taking into account values relating to a desired geometric relationship between the first well and the second well, an accuracy value for related drilling measurements, and/or a value associated with drilling consistency.

17. A method for determining a geometric relationship of a second well with respect to a first well, comprising the steps of: producing a magnetic field with a magnetic field source component of a drilling tool positioned within the second well; and producing at least one output from at least one magnetic field sensor capable of sensing directional magnetic field components in response to detection of the magnetic field, wherein the at least one magnetic field sensor is positioned in a non-magnetic region of casing within the first well, the first well having alternating regions of magnetic casing and non-magnetic casing wherein the non-magnetic casing regions are separated by a distance, the distance is based on an accuracy value for related drilling measurements, values relating to a desired geometric relationship between the first well and the second well, or a value associated with drilling consistency.

18. The method of claim 17, comprising moving the magnetic field source by drilling in intervals of an approximate distance corresponding to the distance between the regions of non-magnetic casing to facilitate taking a series of measurements.

* * * * *